US010280741B2

(12) United States Patent
Derkacz et al.

(10) Patent No.: US 10,280,741 B2
(45) Date of Patent: May 7, 2019

(54) OPTIMIZING DOWNHOLE DATA COMMUNICATION WITH AT BIT SENSORS AND NODES

(71) Applicant: EVOLUTION ENGINEERING INC., Calgary (CA)

(72) Inventors: Patrick R. Derkacz, Calgary (CA); Aaron William Logan, Calgary (CA); Justin C. Logan, Calgary (CA); Jili Liu, Calgary (CA); David A. Switzer, Calgary (CA); Robert Harris, Calgary (CA); Barry Daniel Buternowsky, Calgary (CA); Kurtis West, Calgary (CA)

(73) Assignee: Evolution Engineering Inc., Calgary (CA)

( * ) Notice: Subject to any disclaimer, the term of this patent is extended or adjusted under 35 U.S.C. 154(b) by 0 days.

(21) Appl. No.: 16/163,168

(22) Filed: Oct. 17, 2018

(65) Prior Publication Data

US 2019/0048713 A1 Feb. 14, 2019

Related U.S. Application Data

(62) Division of application No. 15/321,675, filed as application No. PCT/CA2015/050422 on May 8, 2015, now Pat. No. 10,119,393.

(60) Provisional application No. 62/015,817, filed on Jun. 23, 2014.

(51) Int. Cl.
*E21B 47/12* (2012.01)
*E21B 47/04* (2012.01)

(52) U.S. Cl.
CPC ..... *E21B 47/122* (2013.01); *E21B 47/04* (2013.01)

(58) Field of Classification Search
None
See application file for complete search history.

(56) References Cited

U.S. PATENT DOCUMENTS

| | | | |
|---|---|---|---|
| 3,186,222 | A | 6/1965 | Martin |
| 4,087,781 | A | 5/1978 | Grossi et al. |
| 4,390,975 | A | 6/1983 | Shawhan |
| 4,739,325 | A | 4/1988 | MacLeod |
| 4,800,385 | A | 1/1989 | Yamazaki |
| 4,968,978 | A | 11/1990 | Stolarczyk |

(Continued)

FOREIGN PATENT DOCUMENTS

| | | |
|---|---|---|
| EP | 0932054 A2 | 7/1999 |
| EP | 0900917 B1 | 3/2001 |

(Continued)

OTHER PUBLICATIONS

Reeves, M. et al., "Intelligent Drill String Field Trials Demonstrate Technology Functionality", SPE Drilling Conference, Feb. 25, 2005, p. 1-12.

*Primary Examiner* — Curtis J King
(74) *Attorney, Agent, or Firm* — Oyen Wiggs Green & Mutala LLP

(57) ABSTRACT

Data is communicated from sensors at a downhole location near a drill bit to surface equipment. Communication to the surface equipment may be direct or may pass through a series of nodes. The nodes in some cases are intelligently reconfigured to achieve desired data rates, achieve power management goals, and/or compensate for failed nodes.

5 Claims, 8 Drawing Sheets

(56) References Cited

U.S. PATENT DOCUMENTS 5,160,925 A 11/1992 Dailey et al.
5,467,083 A 11/1995 McDonald et al.
5,530,358 A 6/1996 Wisler et al.
5,942,990 A 8/1999 Smith et al.
6,018,501 A 1/2000 Smith et al.
6,048,301 A 4/2000 Sabuda
6,075,461 A 6/2000 Smith
6,144,316 A 11/2000 Skinner
6,177,882 B1 1/2001 Ringgenberg et al.
6,218,959 B1 4/2001 Smith
6,633,236 B2 10/2003 Vinegar et al.
6,816,082 B1 11/2004 Laborde
6,937,159 B2 8/2005 Hill et al.
7,200,070 B2 4/2007 Hall et al.
7,207,396 B2 4/2007 Hall et al.
7,228,902 B2 6/2007 Oppelt
7,234,519 B2 6/2007 Fripp et al.
7,327,323 B2 2/2008 Jackson et al.
7,347,271 B2 3/2008 Ohmer et al.
7,453,372 B2 11/2008 Hentati et al.
7,477,160 B2 1/2009 Lemenager et al.
7,768,423 B2 8/2010 Camwell et al.
7,999,695 B2 8/2011 Rodney et al.
8,031,081 B2 10/2011 Pisoni et al.
8,115,651 B2 2/2012 Camwell et al.
8,179,278 B2 5/2012 Shakra et al.
8,242,928 B2 8/2012 Prammer
8,407,006 B2 3/2013 Gleitman
8,605,548 B2 12/2013 Froelich
8,622,153 B2 1/2014 McLoughlin et al.
8,636,060 B2 1/2014 Hernandez
8,695,727 B2 4/2014 Chau et al.
8,704,677 B2 4/2014 Prammer
8,711,045 B2 4/2014 Contant et al.
2002/0030604 A1* 3/2002 Chance ..... H04Q 9/00 340/870.09
2002/0163441 A1 11/2002 Hill et al.
2003/0020631 A1 1/2003 Haase et al.
2003/0025639 A1 2/2003 Rodney et al.
2003/0098799 A1 5/2003 Zimmerman
2003/0142586 A1* 7/2003 Shah ..... E21B 41/0035 367/82
2003/0205375 A1* 11/2003 Wright ..... E21B 43/26 166/250.1
2004/0156264 A1 8/2004 Gardner et al.
2004/0238166 A1 12/2004 Salamitou et al.
2005/0035874 A1 2/2005 Hall et al.
2005/0056461 A1* 3/2005 Estes ..... E21B 47/022 175/45
2005/0157699 A1 7/2005 Sakai
2005/0200497 A1* 9/2005 Smithson ..... G01V 11/002 340/853.3
2006/0013065 A1 1/2006 Varsamis et al.
2006/0022839 A1 2/2006 Hall et al.
2006/0100968 A1 5/2006 Hall et al.
2006/0113803 A1 6/2006 Hall et al.
2007/0079988 A1* 4/2007 Konschuh ..... E21B 4/02 175/40
2007/0247330 A1 10/2007 Clark
2008/0007421 A1 1/2008 Liu et al.
2008/0211687 A1 9/2008 Price et al.
2008/0253228 A1* 10/2008 Camwell ..... E21B 47/12 367/82
2009/0101329 A1* 4/2009 Clem ..... E21B 43/12 166/66.6
2009/0146835 A1 6/2009 Xu et al.
2009/0166031 A1 7/2009 Hernandez
2010/0085210 A1* 4/2010 Bonavides ..... E21B 43/11 340/853.2
2010/0133006 A1* 6/2010 Shakra ..... E21B 41/0085 175/24
2010/0149056 A1 6/2010 Contant et al.
2010/0182161 A1 7/2010 Robbins et al.
2011/0168446 A1 7/2011 Lemenager et al.
2011/0187553 A1 8/2011 Rodney
2011/0192592 A1 8/2011 Roddy et al.
2011/0192597 A1 8/2011 Roddy et al.
2011/0205080 A1 8/2011 Millot et al.
2011/0247803 A1* 10/2011 Rodney ..... G01V 11/002 166/254.2
2011/0248566 A1 10/2011 Purkis
2012/0146805 A1 6/2012 Vick, Jr. et al.
2012/0249338 A1 10/2012 Merino
2012/0286967 A1* 11/2012 Alteirac ..... E21B 47/12 340/853.7
2012/0299743 A1 11/2012 Price et al.
2013/0027216 A1 1/2013 Jantz et al.
2013/0106615 A1 5/2013 Prammer
2013/0146279 A1 6/2013 Chang et al.
2013/0186645 A1 7/2013 Hall
2013/0234859 A1 9/2013 Picioreanu et al.
2013/0239673 A1 9/2013 Garcia-Osuna et al.
2013/0241742 A1 9/2013 Contant et al.
2013/0319767 A1 12/2013 Wilson et al.
2014/0002088 A1 1/2014 Hudson et al.
2014/0055279 A1 2/2014 Hay
2014/0085098 A1 3/2014 Stolpman et al.
2014/0110176 A1 4/2014 Benson
2014/0145857 A1 5/2014 Comparetto
2014/0182845 A1* 7/2014 Roberson ..... E21B 33/13 166/250.07
2014/0265565 A1* 9/2014 Cooley ..... H02P 6/18 307/18
2014/0269188 A1* 9/2014 van Zelm ..... E21B 47/12 367/81
2015/0107824 A1* 4/2015 Signorelli ..... E21B 41/0085 166/244.1
2015/0204186 A1 7/2015 Yang et al.
2015/0293254 A1 10/2015 Wang
2016/0160639 A1 6/2016 Dudley et al.
2017/0211353 A1* 7/2017 Canning ..... E21B 47/12
2018/0058204 A1* 3/2018 Clawson ..... E21B 47/14
2018/0058205 A1* 3/2018 Clawson ..... E21B 47/14
2018/0328120 A1* 11/2018 Therrien ..... E21B 17/023

FOREIGN PATENT DOCUMENTS

EP 0919696 B1 11/2005
EP 2204530 A1 7/2010
EP 2664743 A1 11/2013
GB 2272009 B 5/1994
WO 0029717 A2 5/2000
WO 03067828 A1 8/2003
WO 2007095103 A2 8/2007
WO 2010065205 A1 6/2010
WO 2012131601 A1 10/2012
WO 2013029945 A2 3/2013
WO 2013062949 A1 5/2013
WO 2013079928 A2 6/2013
WO 2013103875 A1 7/2013
WO 201400276 A1 1/2014
WO 2014085936 A1 6/2014
WO 2014092679 A1 6/2014
WO 2014120988 A1 8/2014
WO 2015031973 A1 3/2015

* cited by examiner

OPTIMIZING DOWNHOLE DATA COMMUNICATION WITH AT BIT SENSORS AND NODES

CROSS-REFERENCE TO RELATED APPLICATIONS

This application is a divisional of U.S. application Ser. No. 15/321,675, which is a 371 of International Application No. PCT/CA2015/050422 filed 8 May 2015, which claims the benefit under 35 U.S.C. § 119 of U.S. Application No. 62/015,817 filed 23 Jun. 2014 and entitled DOWNHOLE DATA COMMUNICATION WITH AT BIT SENSORS which is hereby incorporated herein by reference for all purposes.

TECHNICAL FIELD

This application relates to subsurface drilling, specifically, to data communication to and/or from downhole electronic systems. Embodiments are applicable to drilling wells for recovering hydrocarbons.

BACKGROUND

Recovering hydrocarbons from subterranean zones typically involves drilling wellbores.

Wellbores are made using surface-located drilling equipment which drives a drill string that eventually extends from the surface equipment to the formation or subterranean zone of interest. The drill string can extend thousands of feet or meters below the surface. The terminal end of the drill string includes a drill bit for drilling (or extending) the wellbore. Drilling fluid, usually in the form of a drilling "mud", is typically pumped through the drill string. The drilling fluid cools and lubricates the drill bit and also carries cuttings back to the surface. Drilling fluid may also be used to help control bottom hole pressure to inhibit hydrocarbon influx from the formation into the wellbore and potential blow out at surface.

Bottom hole assembly (BHA) is the name given to the equipment at the terminal end of a drill string. In addition to a drill bit, a BHA may comprise elements such as: apparatus for steering the direction of the drilling (e.g. a steerable downhole mud motor or rotary steerable system); sensors for measuring properties of the surrounding geological formations (e.g. sensors for use in well logging); sensors for measuring downhole conditions as drilling progresses; one or more systems for telemetry of data to the surface; stabilizers; heavy weight drill collars; pulsers; and the like. The BHA is typically advanced into the wellbore by a string of metallic tubulars (drill pipe).

Modern drilling systems may include any of a wide range of mechanical/electronic systems in the BHA or at other downhole locations. Downhole electronics may provide any of a wide range of functions including, without limitation: data acquisition; measuring properties of the surrounding geological formations (e.g. well logging); measuring downhole conditions as drilling progresses; controlling downhole equipment; monitoring status of downhole equipment; directional drilling applications; measuring while drilling (MWD) applications; logging while drilling (LWD) applications; measuring properties of downhole fluids; and the like. Downhole electronics may comprise one or more systems for: telemetry of data to the surface; collecting data by way of sensors (e.g. sensors for use in well logging) that may include one or more of vibration sensors, magnetometers, inclinometers, accelerometers, nuclear particle detectors, electromagnetic detectors, acoustic detectors, and others; acquiring images; measuring fluid flow; determining directions; emitting signals, particles or fields for detection by other devices; interfacing to other downhole equipment; sampling downhole fluids; etc.

Downhole electronics may communicate a wide range of information to the surface by telemetry. Telemetry information can be invaluable for efficient drilling operations. For example, telemetry information may be used by a drill rig crew to make decisions about controlling and steering the drill bit to optimize the drilling speed and trajectory based on numerous factors, including legal boundaries, locations of existing wells, formation properties, hydrocarbon size and location, etc. A crew may make intentional deviations from the planned path as necessary based on information gathered from downhole sensors and transmitted to the surface by telemetry during the drilling process. The ability to obtain and transmit reliable data from downhole locations allows for relatively more economical and more efficient drilling operations.

Data communication to and from downhole systems presents significant difficulties. There are several known telemetry techniques. These include transmitting information by generating vibrations in fluid in the bore hole (e.g. acoustic telemetry or mud pulse (MP) telemetry) and transmitting information by way of electromagnetic signals that propagate at least in part through the earth (EM telemetry). Other telemetry techniques use hardwired drill pipe, fibre optic cable, or drill collar acoustic telemetry to carry data to the surface.

Advantages of EM telemetry, relative to MP telemetry, include generally faster baud rates, increased reliability due to no moving downhole parts, high resistance to lost circulating material (LCM) use, and suitability for air/underbalanced drilling. An EM system can transmit data without a continuous fluid column; hence it is useful when there is no drilling fluid flowing. This is advantageous when a drill crew is adding a new section of drill pipe as the EM signal can transmit information (e.g. directional information) while the drill crew is adding the new pipe. Disadvantages of EM telemetry include lower depth capability, incompatibility with some formations (for example, high salt formations and formations of high resistivity contrast), and some market resistance due to acceptance of older established methods. Also, as the EM transmission is strongly attenuated over long distances through the earth formations, it requires a relatively large amount of power so that the signals are detected at surface. The electrical power available to generate EM signals may be provided by batteries or another power source that has limited capacity.

A typical arrangement for electromagnetic telemetry uses parts of the drill string as an antenna. The drill string may be divided into two conductive sections by including an insulating joint or connector (a "gap sub") in the drill string. The gap sub is typically placed at the top of a bottom hole assembly such that metallic drill pipe in the drill string above the BHA serves as one antenna element and metallic sections in the BHA serve as another antenna element. Electromagnetic telemetry signals can then be transmitted by applying electrical signals between the two antenna elements. The signals typically comprise very low frequency AC signals applied in a manner that codes information for transmission to the surface. (Higher frequency signals attenuate faster than low frequency signals.) The electromagnetic signals may be detected at the surface, for example by measuring electrical potential differences between the drill string or a metal casing that extends into the ground and one or more ground rods.

There remains a need for systems for effectively communicating data to and from downhole electronic systems.

SUMMARY

The invention has a number of aspects. Some aspects provide methods of transmitting data along a drill string. Other aspects provide systems, kits and apparatuses for transmitting data along a drill string. Other aspects provide a method for data telemetry from a downhole location One aspect of the invention provides a method for transmitting data along a drill string comprising transmitting a first signal from a first node based on a first transmission setting while the first node is located at a first depth, measuring an aspect of the first signal at a second node, determining a second transmission setting based on the measurement of the measured aspect of the first signal, advancing the drill string so that the second node is proximate to the first depth and transmitting a second signal at the second transmission setting from the second node while the second node is located proximate to the first depth.

In some embodiments, the aspect comprises one or more of signal strength of the first signal at the second node, a harmonic frequency of the first signal and a signal-to-noise ratio of the first signal at the second node.

In some embodiments, the setting comprises one or more of a frequency setting, an amplitude setting and a gain setting. In some embodiments, gain is increased with depth.

In some embodiments, the method comprises transmitting signals from the first node at a first frequency and receiving signals at the first node at a second frequency, wherein the first frequency is different from the second frequency. Signals may also be transmitted from the second node at the second frequency and receiving signals at the second node at the first frequency In some embodiments, the first frequency is filtered out at a receiver of the first node. In other embodiments, a plurality of frequencies are filtered out at the first node, including the first frequency. Filtering may comprise harmonic separation.

In some embodiments, signals are transmitted from the first node at a first polarity and signals are transmitted from the second node at a second polarity, the first polarity opposing the second polarity.

In some embodiments, transmitting a second signal at the second transmission setting comprises decoding and buffering the first signal. In some embodiments, transmitting a second signal at the second transmission setting comprises adding additional data to the first signal. Adding additional data to the first signal may comprise providing a node identifier with the additional data. The node identifier may comprise a time stamp or an incremental count.

In some embodiments, the first node and the second node each comprise an electrically insulating gap and an electromagnetic telemetry transceiver.

In some embodiments, signals are transmitted in a second direction, opposite the first direction in which signals are transmitted using a first and second frequency, using a third and fourth frequency wherein the first, second, third and fourth frequencies are different from one another and the first direction is opposite the second direction. The third and fourth frequencies may be lower than the first and second frequencies.

Another aspect of the invention provides a system for transmitting data along a drill string. The system may comprise a first node operable to transmit signals positioned along the drill string, the first node in communication with one or more sensors, the first node configured to transmit a first signal based on a first transmission setting, a second node operable to transmit signals positioned along the drill string and spaced apart from the first node, the second node in communication with the first node, the second node configured to measure an aspect of a first signal transmitted by the first node while the first node is located at a first depth and a controller configured to determine a second transmission setting based on the aspect of the first signal measured by the second node. The second node may be configured to transmit a second signal at the second transmission setting while the second node is located proximate to the second depth.

In some embodiments, the first node is configured to transmit signals at a first frequency and receive signals at a second frequency, wherein the first frequency is different from the second frequency. In some embodiments, the second node is configured to transmit signals at the second frequency and receive signals at the first frequency. The first node may be configured to filter out at least the first frequency at a receiver of the first node and/or the first node may comprise a filter connected to block at least the first frequency from reaching a receiver of the first node. The filter may use harmonic separation.

In some embodiments, the first node is configured to transmit signals at a first polarity and the second node is configured to transmit signals at a second polarity, the first polarity opposing the second polarity.

Another aspect provides a method for data telemetry comprising providing a drill string in a wellbore, the wellbore passing through formations such that a range of electromagnetic telemetry transmissions varies as a function of depth in the wellbore, passing data from a downhole location to the surface using a plurality of telemetry relay devices between the downhole location and the surface, identifying first and second non-adjacent ones of the telemetry relay devices such that the second one of the telemetry relay devices is within the range for electromagnetic telemetry transmissions corresponding to the location of the first one or the telemetry relay devices and inhibiting operation of one or more of the telemetry relay devices between the first and second ones of the telemetry relay devices.

In some embodiments, the method comprises advancing the drill string until the range of electromagnetic telemetry transmissions corresponding to the location of the first one of the telemetry relay devices is reduced and then activating one or more of the one or more electromagnetic telemetry relay devices between the first and second ones of the electromagnetic telemetry relay devices.

In some embodiments, the method comprises monitoring the range of the electromagnetic telemetry signals by transmitting electromagnetic telemetry signals from a transmitter on the drill string and receiving the electromagnetic telemetry signals transmitted by the transmitter at a plurality of the electromagnetic telemetry relay devices.

In some embodiments, the transmitter is a transmitter of one of the electromagnetic telemetry relay devices.

Another aspect provides a method for data telemetry comprising providing a plurality of telemetry relay devices at locations spaced apart along a drill string, each of the telemetry relay devices comprising an electromagnetic telemetry signal receiver and an electromagnetic telemetry signal transmitter, moving the drill string in a wellbore, identifying a first region of the wellbore in which electromagnetic telemetry transmissions are attenuated more strongly and a second region of the wellbore in which electromagnetic telemetry transmissions are attenuated less strongly, passing data up the drill string by sequentially relaying the data by electromagnetic telemetry from one of the relay devices to another and automatically inhibiting operation of some of the telemetry relay devices while those telemetry relay devices are in the second region.

Further aspects of the invention and features of example embodiments are illustrated in the accompanying drawings and/or described in the following description.

BRIEF DESCRIPTION OF THE DRAWINGS

The accompanying drawings illustrate non-limiting example embodiments of the invention.

DESCRIPTION

Throughout the following description specific details are set forth in order to provide a more thorough understanding to persons skilled in the art. However, well known elements may not have been shown or described in detail to avoid unnecessarily obscuring the disclosure. The following description of examples of the technology is not intended to be exhaustive or to limit the system to the precise forms of any example embodiment. Accordingly, the description and drawings are to be regarded in an illustrative, rather than a restrictive, sense.

Figure 1:
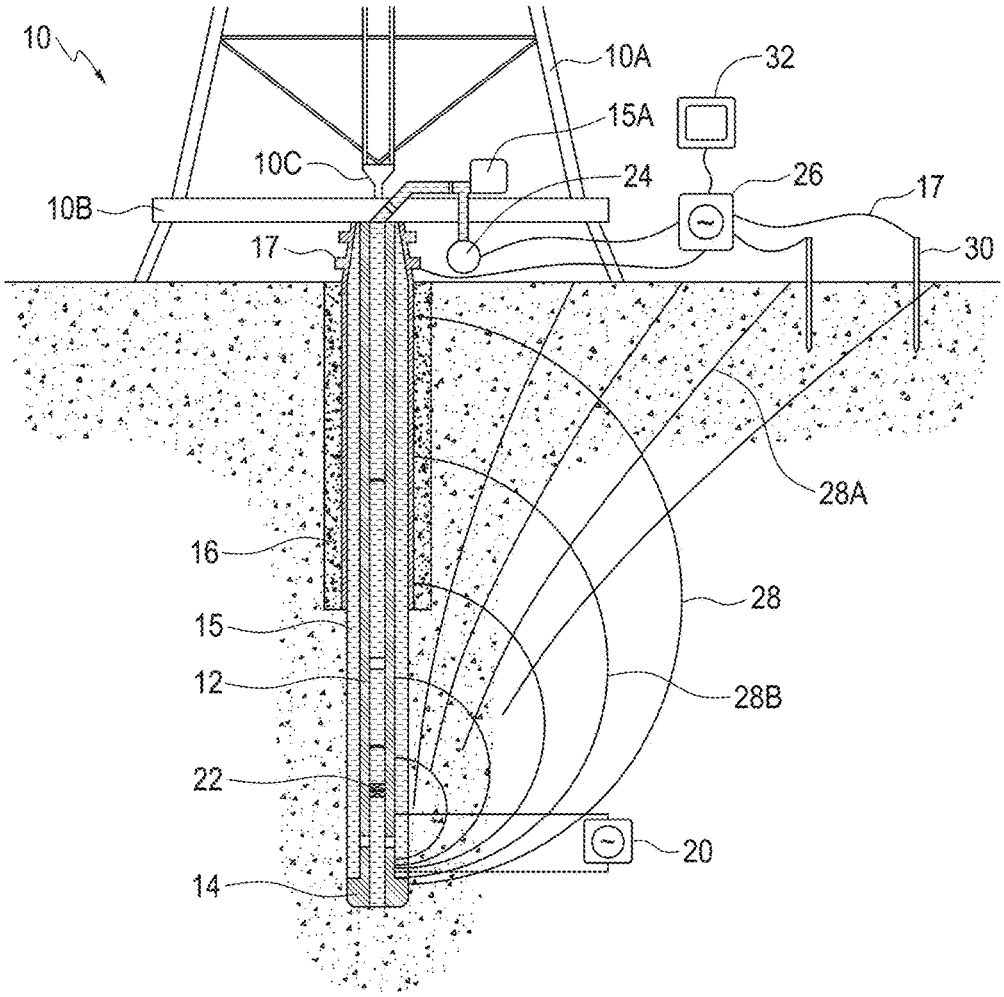
FIG. 1 is a schematic view of a drilling operation.

FIG. 1 shows schematically an example drilling operation. A drill rig 10 drives a drill string 12 which includes sections of drill pipe that extend to a drill bit 14. The illustrated drill rig 10 includes a derrick 10A, a rig floor 10B and draw works 100 for supporting the drill string. Drill bit 14 is larger in diameter than the drill string above the drill bit. An annular region 15 surrounding the drill string is typically filled with drilling fluid. The drilling fluid is pumped through a bore in the drill string to the drill bit and returns to the surface through annular region 15 carrying cuttings from the drilling operation. As the well is drilled, a casing 16 may be made in the wellbore. A blow out preventer 17 is supported at a top end of the casing. The drill rig illustrated in FIG. 1 is an example only. The methods and apparatus described herein are not specific to any particular type of drill rig.

One aspect of this invention provides downhole data networks, nodes for downhole data networks, and methods for transmitting data from an electronics system in a wellbore to the surface by way of a number of relay nodes. In some embodiments, nodes of the network have built-in intelligence which controls the nodes to perform one or more of:

managing power consumption;

maintaining a desired data rate;

maintaining reliable data transmission.

In some embodiments, the nodes communicate with one another and/or with surface equipment by EM telemetry. The nodes may communicate with one another using frequencies that are high in comparison to the frequencies normally used for EM telemetry. In some embodiments, EM signals from the nodes have relatively short ranges (e.g. less than about 1000 feet—approximately 300 m and typically 200 feet—approximately 60 m or less.). Nodes may be spaced apart such that each node can transmit to one or more other nodes. In some embodiments adjacent nodes are 60 to 250 feet (about 20 m to about 80 m) apart.

In other embodiments, the drill string is separated into a plurality of conductive sections that are electrically isolated by one or more electrically insulating gaps, such as is described in International Publication No. WO 2015/031973.

Another aspect of the invention provides an EM telemetry system having a transmitter located between a mud motor and a drill bit. This EM telemetry system may be applied to communicate data directly to a surface-located receiver or to transmit data to the surface by way of a system comprising one or more data relays. In some embodiments, the range of transmitted EM telemetry signals is optimized by providing a relatively large gap for the EM telemetry transmitter. These aspects may be used individually and may also be combined.

One advantage of using EM telemetry to transmit data from a location below a mud motor to a location above the mud motor is that EM telemetry signals are not affected significantly by the higher rotation speed of the parts of the drill string below the mud motor.

In some embodiments, the power of the EM telemetry transmitter located below the mud motor is relatively low. For example, the transmission power may be two watts or less. Such low power transmission may be sufficient to transmit an EM telemetry signal to a receiver located nearby, for example, a receiver located in the BHA above the mud motor. The receiver may be associated with a battery or other power source which permits higher power telemetry transmissions either all the way to the surface or to another receiver in a node farther up the drill string.

In some embodiments, an EM telemetry transmitter has two or more operating nodes. One node may use low-frequency (e.g. <20 Hz) higher-power signals to transmit over a long range. Another node may use higher frequencies and optionally lower power to transmit data over a shorter range.

Figure 2:
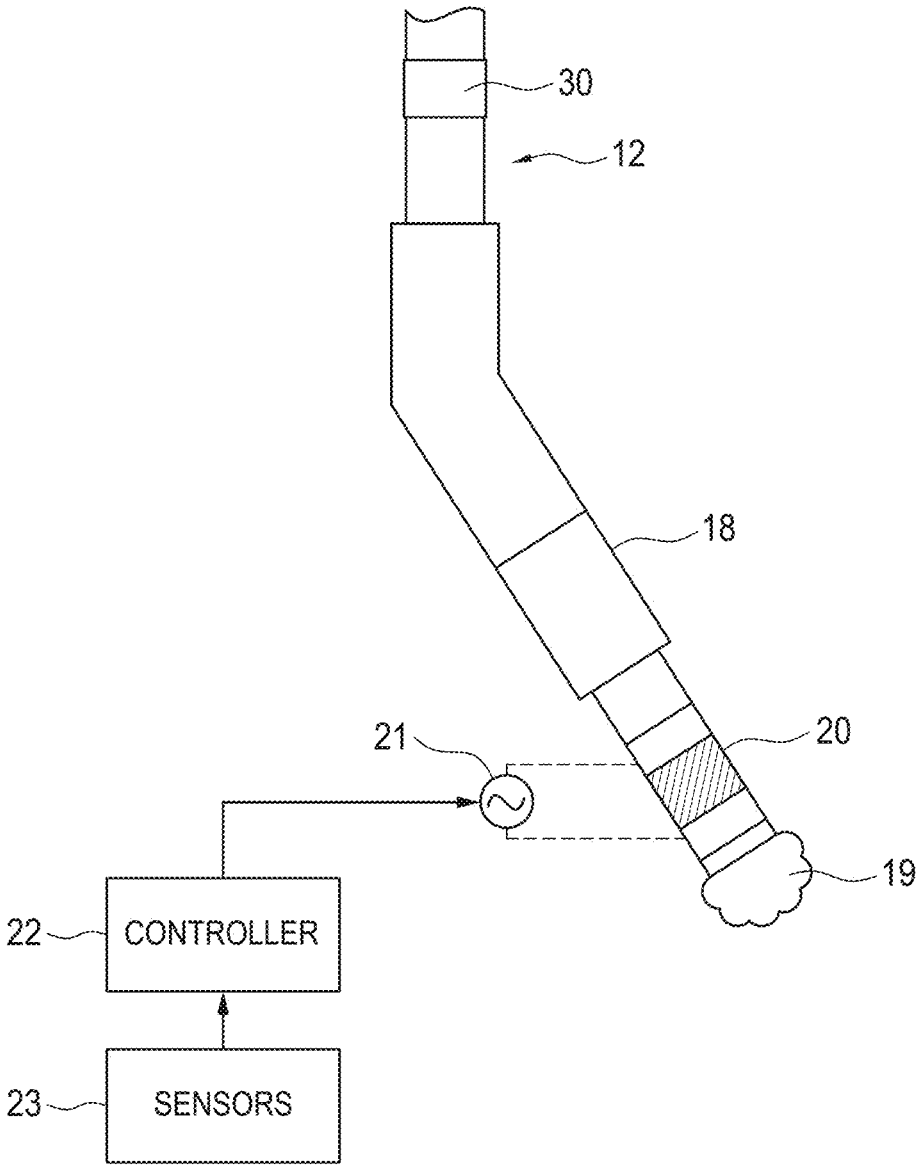
FIG. 2 is a schematic view of a lower end of a drill string.

FIG. 2 shows schematically the lower end of a drill string 12. FIG. 2 shows a mud motor 18 connected to drive a drill bit 19. An electrically insulating gap 20 is provided in the drill string between the mud motor 18 and the drill bit 19. Gap 20 may, for example, be provided in a sub which is coupled to the mud motor at one end and to the drill bit at another end. In an alternative embodiment, gap 20 is integrated with mud motor 18. In another alternative embodiment, gap 20 is integrated with drill bit 19.

An EM telemetry transmitter indicated schematically by 21 is connected across gap 20. EM telemetry transmitter 21 is configured to apply a potential difference across gap 20. By altering the magnitude and/or polarity of the potential difference in a pattern, EM telemetry transmitter 21 can transmit signals by way of an electrical field which may be picked up at the surface and/or at an EM telemetry receiver located at some point below the surface.

One or more sensors 23 is provided. The sensors are connected to generate data that can be transmitted by EM telemetry transmitter 21. These sensors may, for example, include MWD sensors. The MWD sensors may, for example, include an inclination sensor, a directional sensor (e.g. a magnetic field detector), and/or sensors for detecting characteristics of the surrounding formations, for example, a gamma sensor, a resistivity sensor, or the like and/or sensors for monitoring downhole conditions, e.g. a pressure sensor, a temperature sensor, a shock/vibration sensor, or the like. A controller 22 takes readings from sensors 23, encodes the results for transmission by EM telemetry signals, and causes EM telemetry transmitter 21 to transmit the EM telemetry signals. These sensors may also be located between the mud motor and the drill bit.

Where the sensors include an inclination sensor located below the mud motor, since the portion of the drill string including the inclination sensor will often be rotating, an average inclination sensor reading may be obtained in order to measure an inclination of the drill string at the location of the sensor.

In the case where the sensors include a sensor that is directional, for example, a directional gamma sensor, the rotation of the drill string may be monitored (e.g. by monitoring an output of a direction sensor and/or an output of an inclination sensor). Sensor readings from the direction of sensors may be binned into bins corresponding to different quadrants of rotation. For example, each full rotation may be divided into four, eight, twelve, or any other suitable number of bins. Readings from the sensor (e.g. a directional gamma sensor) may be accumulated in the corresponding bins for a suitable integration time and then transmitted.

Figure 3:
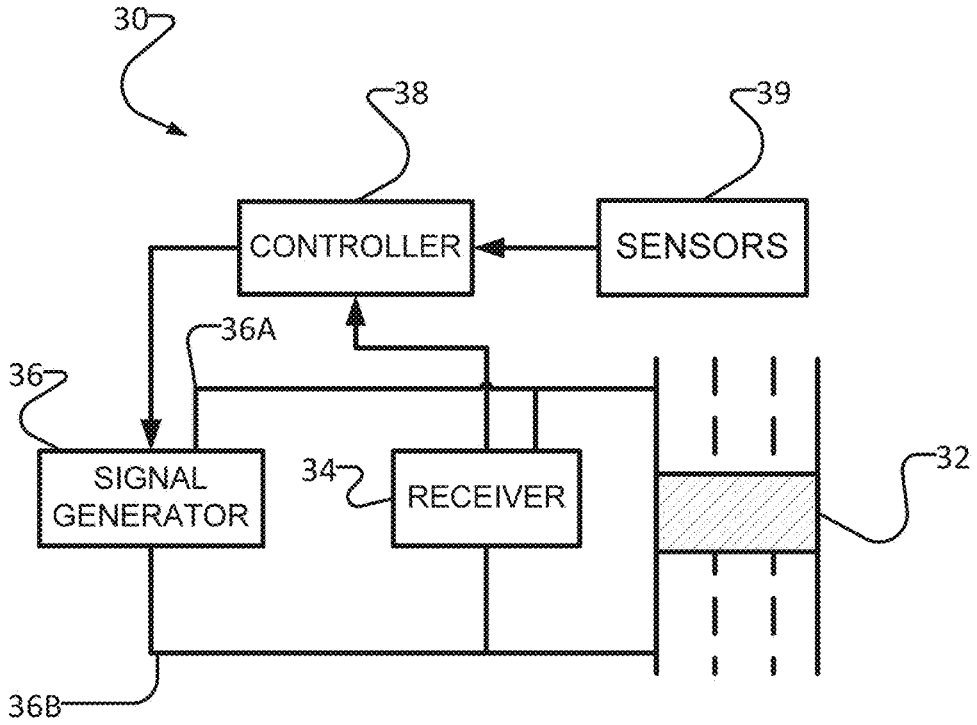
FIG. 3 is a block diagram of a node for a downhole data network.

FIG. 2 also shows a data transmission network that includes a node 30 located between the surface and the mud motor 18. FIG. 3 is a block diagram of an example node 30. Node 30 includes an electrically insulating gap 32 across which is connected an EM telemetry receiver 34. EM telemetry receiver 34 is configured to monitor a potential difference across gap 32. Node 30 also includes an EM telemetry signal generator 36. EM telemetry signal generator 36 has outputs 36A and 36B connected to opposing sides of gap 32. Node 30 can transmit a signal, which may be received at the surface, or at another node, by controlling EM telemetry signal generator 36 to apply a voltage signal across gap 32 which is modulated to encode information.

It is not necessary for node 30 to completely decode received signals to obtain the originally transmitted data before retransmitting the data. In some embodiments, node 30 is configured to work without decoding the signals, for example, by detecting phase changes or other characteristics of received signals and modulating a transmit signal in the same way such that the retransmitted signal includes the data encoded in the original signal.

In other embodiments, node 30 decodes received data and then re-encodes the received data for retransmission. In doing so, node 30 may add data (for example, readings from one or more sensors 39 at node 30).

Node 30 includes a controller 38. In some embodiments, controller 38 is configured to retransmit data from signals that have been received using EM telemetry receiver 34. In an example embodiment, EM telemetry receiver 34 receives signals from farther downhole in the wellbore and then controller 38 controls EM telemetry transmitter 36 to retransmit those signals so that the signals can be received at the surface or by other nodes farther uphole in the wellbore.

Node 30 optionally includes one or more sensors 39. Node 30 may take readings from the one or more sensors 39 and may transmit those readings to the surface and/or to other nodes for transmission to the surface. The additional sensors 39 in node 30 may, for example, include sensors such as a directional sensor, a sensor measuring torque and/or tension in the drill string at the location of the node, a gamma sensor, a pressure sensor, a shock/vibration sensor, or the like.

Data from sensors 39 spaced along the drill string may give real-time information on the variation of a wide range of parameters with depth. This information has many applications including real-time predictive failure analysis.

Readings from sensors 39 may be applied in a wide range of applications. For example, where sensors 39 include pressure sensors, a set of readings from sensors 39 can provide a profile of pressure vs. depth. Such a profile may, for example, be used to identify formations that have collapsed such that drilling fluid is being lost into the formations.

As another example, where sensors 39 include torque sensors and/or tension, stress, strain sensors, readings from sensors 39 may indicate areas within the well bore where the drill string is dragging against the well bore. Such areas may be subsequently reamed out to reduce drag.

As another example, information from formation resistivity sensors may be used to build a profile of resistivity vs. depth. This information may be used by nodes 30 to control EM telemetry power and/or frequency and/or to control routing of data especially in and around formations which have low resistivity and therefore tend to attenuate EM telemetry signals.

In some embodiments, nodes 30 are spaced relatively close together such that they can receive signals from other nodes 30 or from another downhole signal source that would be too weak to detect at the surface. For example, EM telemetry signals transmitted between nodes 30 may be transmitted at frequencies that are high enough that the signals would be so attenuated by the time they reach the surface from the locations of some of the nodes 30 that the signals would be undetectable by normal surface equipment. Use of higher frequency signals facilitates higher data rates.

The frequencies used to transmit by the nodes 30 may be higher than the frequencies normally used for EM telemetry transmission from downhole to the surface. For example, in some embodiments, the frequencies may be frequencies of up to 2 kHz or so. In some embodiments, the frequencies are above 300 Hz and below 2 kHz. In some embodiments, the frequencies are in the range of 20 Hz to 20 kHz. Even higher frequencies may be used in some embodiments. Using EM transmission frequencies above 300 Hz is advantageous since harmonics of such frequencies tend to be quickly attenuated.

The frequencies to be used to transmit EM telemetry signals may be set, for example, based on factors such as the type of drilling fluid being used (drilling fluids that are less-conductive such as oil-based drilling fluids tend to attenuate higher-frequency EM telemetry signals less than more-conductive drilling fluids such as brine or water-based drilling fluids).

Figure 4A:
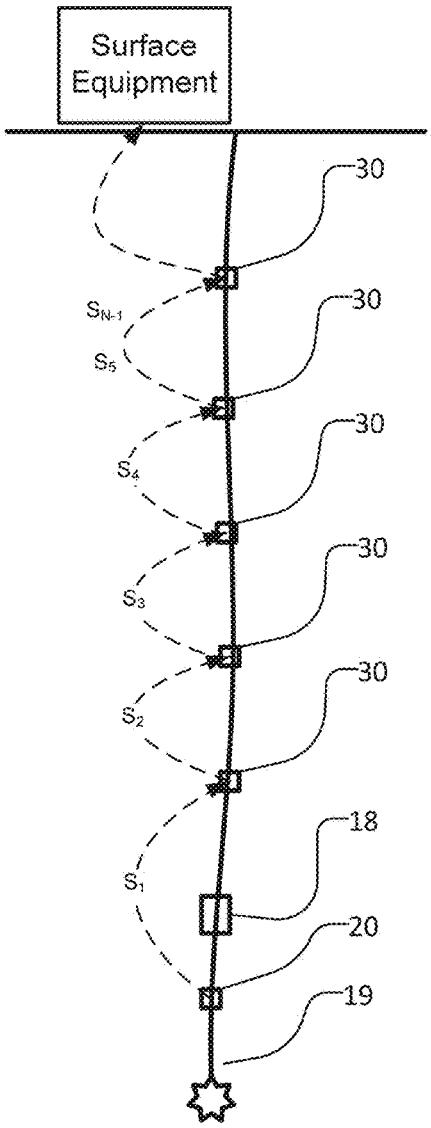
FIGS. 4A through 4D are schematic views showing various options for transmitting data to surface equipment.

In a simple embodiment illustrated in FIG. 4A, signals from a set of sensors at a downhole location, for example, a location in the BHA or a location between the mud motor and drill bit, may be transmitted sequentially from a lowest node on the drill string to the next lowest node on the drill string and so on until the signals are finally received at surface equipment. In such embodiments, each node may transmit signals with relatively low power because the signals only need to be strong enough to reliably reach the next node. In addition, some or all nodes may be configured to transmit and/or receive signals having frequencies significantly higher than the very low frequencies (typically <20 Hz) used for downhole-to-surface EM telemetry.

Although such higher frequencies are attenuated strongly, the nodes may be close enough together to receive the higher-frequency signals. One advantage of higher-frequency signals is the possibility of providing significantly faster data rates than can be achieved using lower frequencies. There is a trade-off between using lower frequencies which typically can be received at longer range (and therefore permit wider spacing apart of nodes 30) and using higher frequencies which facilitate lower latency and higher data rates.

In some embodiments, nodes 30 are configured to receive EM telemetry signals having one frequency and to transmit EM telemetry signals at a different frequency. An EM telemetry receiver in a node 30 may include a filter that blocks the node's transmit frequency. In such embodiments, the node 30 may simultaneously receive EM telemetry signals by monitoring potential difference across a gap and transmit EM telemetry signals at the transmit frequency by imposing a potential across the gap that is modulated at the transmit frequency.

Figure 6:
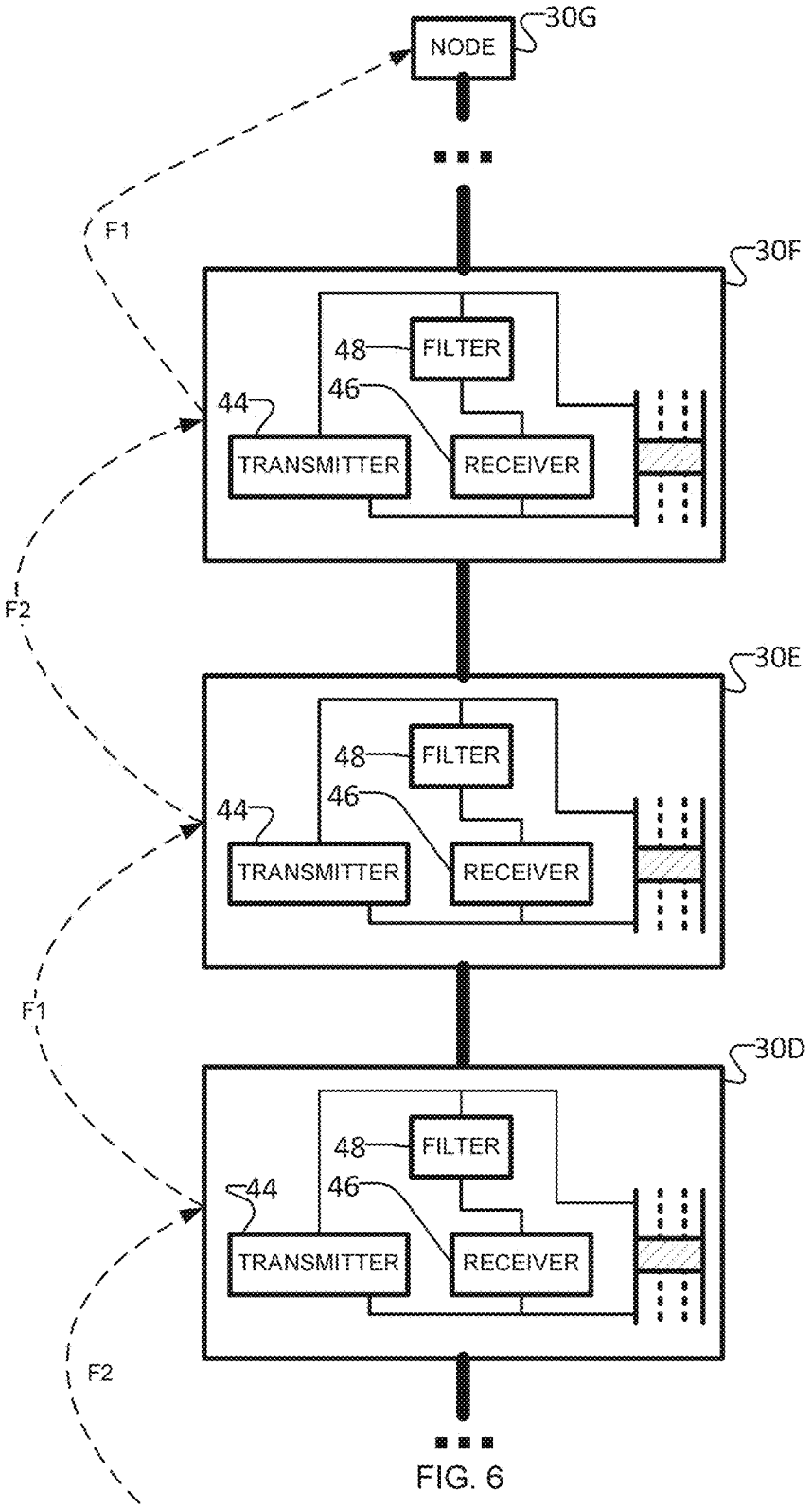
FIG. 6 is a block diagram showing a plurality of nodes receiving and transmitting data.

An example is shown in FIG. 6. FIG. 6 shows a section of a drill string having a plurality of nodes 30. Each node 30 is associated with an electrically-insulating gap such that an electrically conductive section of the drill string above the gap is electrically insulated from an electrically-conductive section of the drill string below the gap. Each node 30 comprises an EM telemetry transmitter 44 connected to apply an EM telemetry signal across the corresponding gap and an EM telemetry receiver 46 configured to detect EM telemetry signals by monitoring potential differences across the gap. In this illustrative embodiment, each EM telemetry receiver incorporates a filter 48 which is tuned to block signals issuing from the EM telemetry transmitter of the node 30.

In this illustrated embodiment, the transmit frequencies of nodes 30 alternate between two frequencies, F1 and F2, as one moves along the drill string. In this embodiment, a telemetry signal carrying data to be transmitted along the drill string is transmitted at frequency F1 from node 30D. The signal is not received by the receiver of node 30D because that receiver includes a filter which blocks frequency F1. The signal is received at node 30E which retransmits the data in an EM telemetry signal having frequency F2. The retransmitted data is not received by the receiver at node 30E because node 30E includes a filter which blocks frequency F2 from being received. The signal at frequency F2 is received by node 30F which then retransmits the data in an EM telemetry signal having a frequency different from F2, for example, having a frequency F1. Since each node 30 does not receive the signals that it is transmitting, transmission and reception of the same or different data can proceed simultaneously at a node. Relay or node lag time may be essentially eliminated in some embodiments.

In some embodiments, frequencies F1 and F2 are transmitted along the drill string in an uphole direction. In other embodiments, frequencies F1 and F2 are transmitted along the drill string in a downhole direction. In other embodiments, frequencies F1 and F2 may be transmitted along the drill string in either an uphole or a downhole direction.

In some embodiments, nodes 30 may transmit at additional frequencies F3 and F4. For example, frequencies F3 and F4 may be used to transmit in a downhole direction while frequencies F1 and F2 are used to transmit in an uphole direction. In some embodiments, frequencies F3 and F4 may be lower than frequencies F1 and F2 since less information may need to be transmitted in a downhole direction (e.g. a downhole transmission may comprise instructions to change modes while and uphole transmission may comprise larger amounts of data, as described herein).

In some embodiments, the existence of electrically-insulating gaps in the drill string at nodes 30 limits the propagation of signals from a node 30. For example, the gap at node 30E may cause the signal transmitted by node 30D to be greatly attenuated above node 30E in the drill string. Thus, node 30G can receive the signal at frequency F1 from node 30F without interference from the signal from node 30D which is also at frequency F1. It is optionally possible to connect filters, inductive couplings or the like across the gaps of some nodes which pass signals at select frequencies to facilitate longer-range transmission of signals at the select frequencies along the drill string. These frequency-selective paths across the gaps may optionally be switched in or out by nodes 30.

Some embodiments provide nodes which include EM telemetry transmitters that transmit at a transmit frequency $F_T$ and receivers that include filters that block signals at the transmit frequency for the node. This permits individual nodes to be transmitting and receiving simultaneously which facilitates reduced latency in transmitting data along the drill string.

The transmit and receive frequencies for any node may be selected such that they differ sufficiently to permit the receiver filter to block the transmit frequency while passing signals at one or more frequencies to be received. In an example embodiment, F1 is 1,100 Hz while F2 is 2,000 Hz. In another example embodiment, F1 is 12 Hz and F2 is 500 Hz. In another example embodiment F1 and F2 are each in the range of 1 Hz to 10 kHz.

It is not mandatory that there be but a single transmit frequency and a single receive frequency at any node. In some embodiments transmission occurs simultaneously at two or more frequencies and/or reception occurs simultaneously at two or more frequencies. In such embodiments, one or more filters are provided which block all of the transmit frequencies from being detected at a receiver.

In some embodiments, some or all nodes 30 include data stores and are configured to create logs of received and/or transmitted data in the data stores. The logs may also store records of the outputs of sensors 39 located at the node. Such logs may be applied to recover data in the event of a telemetry failure and/or to determine ways to optimize operation of the system and/or to diagnose problems with drilling and/or telemetry.

Figure 4B:
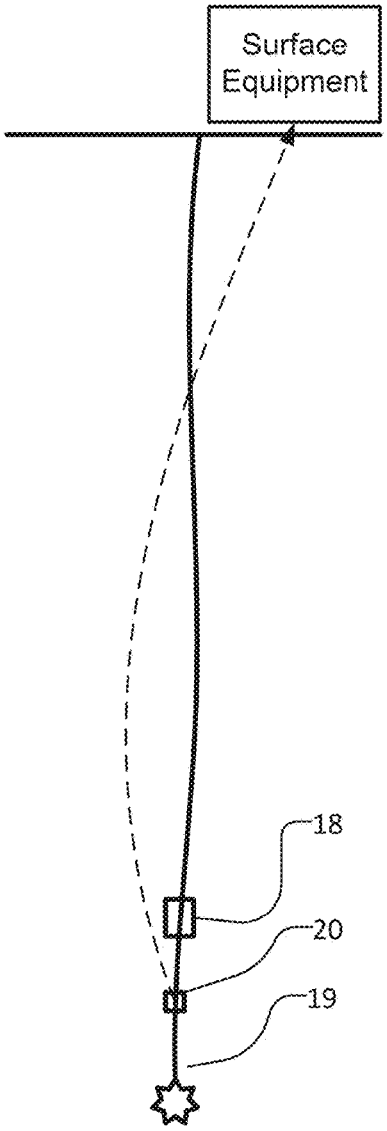

FIG. 4B shows another embodiment wherein EM telemetry data is transmitted directly to the surface from a location between a mud motor and a drill bit.

The distance between the nodes and the range of the nodes may be adjusted based on various factors. These factors may include information about formations through which the wellbore will pass as well as the desired EM transmit frequency ranges for nodes 30.

In some cases, drilling is being done through formations which include formations which are poor for EM telemetry transmissions. Such poor formations may, for example, have high electrical conductivity, thereby causing EM telemetry transmissions to be significantly attenuated. In some such cases the distances between the EM telemetry nodes may be selected such that the nodes are close enough that even under the worst case scenario of the bad formation the signals emitted by one node can be picked up by the next node along the drill string.

In some embodiments, the spacing between nodes 30 is on the order of a few hundred feet. For example, the nodes may be separated from their nearest-neighbour nodes by distances of 150 to 750 feet (about 50 meters to about 250 meters). In cases where it is known that the well bore penetrates a formation that is poor for EM telemetry (e.g. a formation with high electrical conductivity), nodes may be spaced more closely together in that part of the drill string that will be below the top of the poor formation and may be more widely spaced apart above that.

In some embodiments, a node is coupled to the drill string after approximately every N drill string segments where N is, for example, a number in the range of about 3 to 30. The drill string segments may, for example, each be approximately 30 feet (10 meters) long.

Optimizations can be achieved by providing control over the nodes 30. Such control may be exercised from a central controller, which may be incorporated in surface equipment or may be a downhole controller. In some alternative embodiments, some or all aspects of such control are distributed among the nodes. Such control may be applied to adapt the network of nodes to various conditions that may develop. For example, the control may compensate for a node that has failed or a node whose batteries are running down or have run out.

In such cases, a node below a failed node may be operated to transmit with increased power and/or a node uphole from a failed node may be tuned to receive signals from a node downhole from the failed node and/or a node uphole from the failed node may have its receiver gain increased.

Figure 4C:
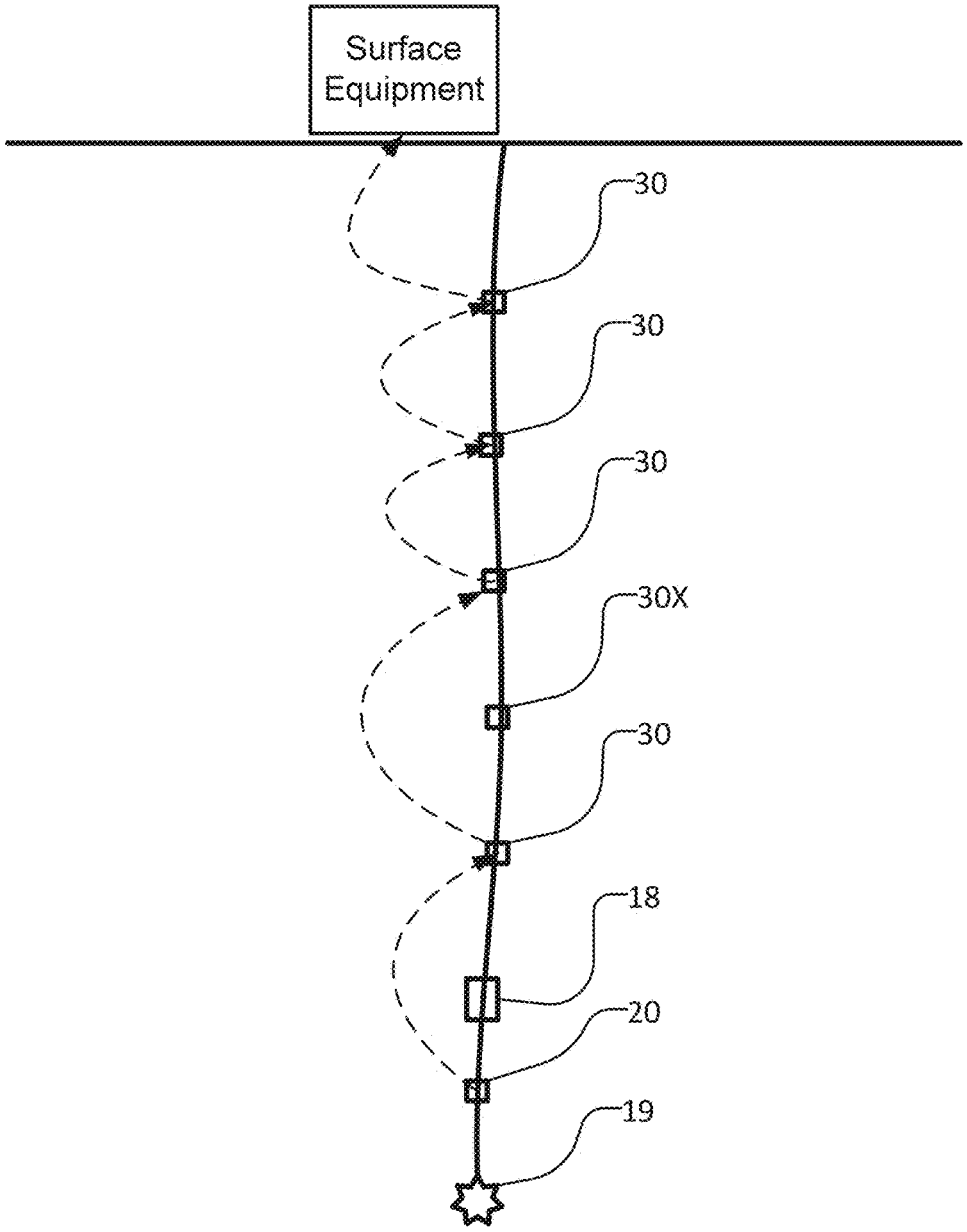

FIG. 4C illustrates an example where EM telemetry signals are relayed past a failed node 30X.

The control may also be applied to conserve battery power by reducing transmission power when possible and/or putting some nodes in standby mode in portions of the drill string at which the range of one node is long enough that signals from the one node can be picked up from other non-adjacent nodes.

In an example embodiment, nodes in all or part of the drill string have a low-power mode where every second node is in a standby mode and another mode in which all nodes are operating to relay data. The network may be switched between these modes in response to a control signal, a measured signal quality (e.g. signal to noise ratio) at one or more modes or the like. If the signal to noise ratio ("SNR") is high the low-power mode may be selected. If SNR drops below a threshold the network may be placed in a mode where all nodes participate in relaying data.

Figure 4D:
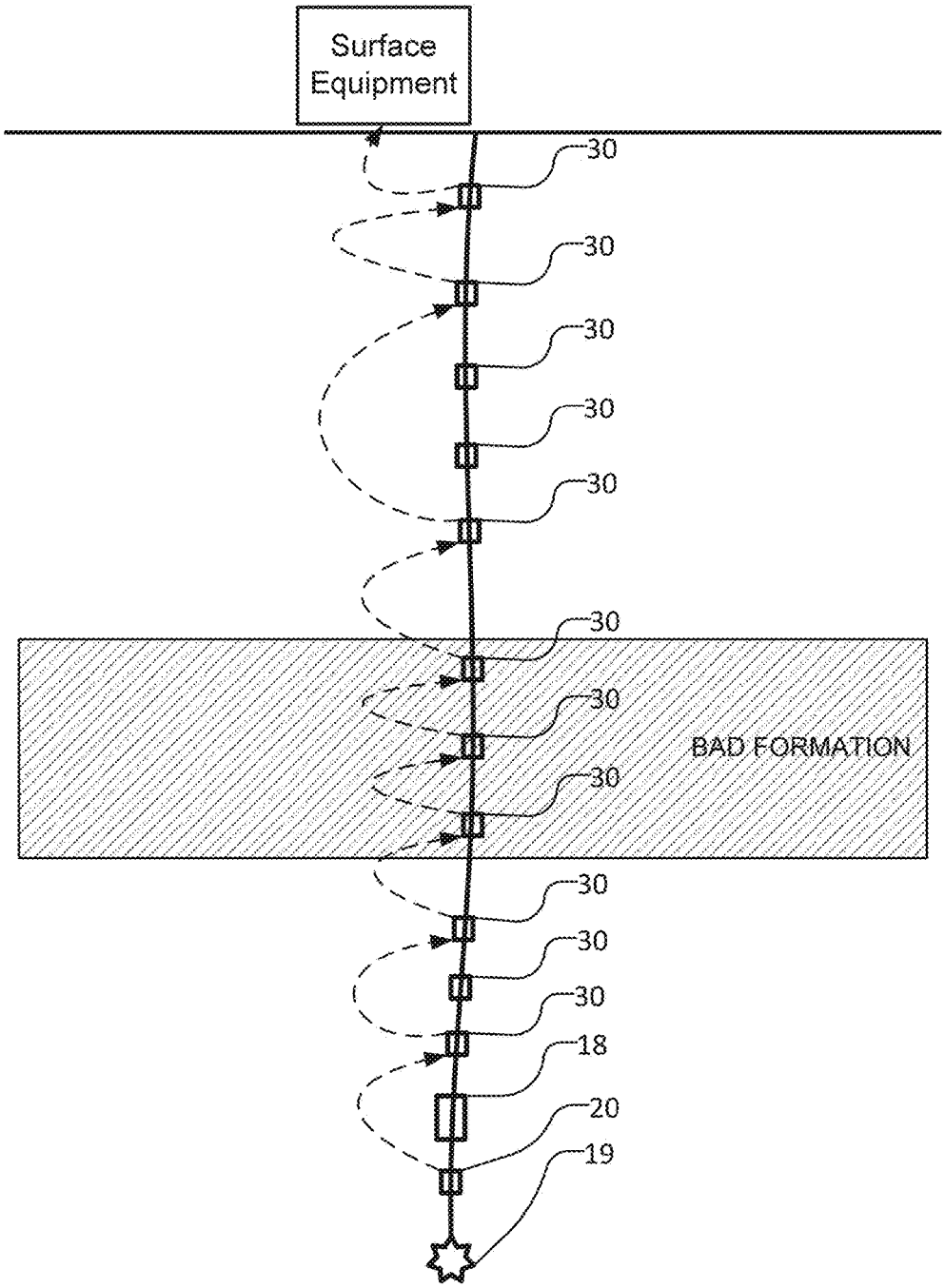

FIG. 4D illustrates an example case where some nodes in some parts of a drill string are in standby mode while nodes in other parts of the drill string are all used. In embodiments where nodes include sensors 39 a node may continue to log readings from any associated sensors 39 while it is in standby mode.

In another application, a node may receive signals from a number of downhole nodes and may distinguish those signals by their frequencies or other signal characteristics. In such cases, the signals transmitted by the adjacent node may be redundant. The node may transmit to the adjacent node a signal indicating that it is not currently needed. In response, the adjacent node may go into a standby mode. Other more sophisticated schemes are possible in which, in areas of a drill string where signals propagate for relatively long distances with reduced attenuation, intermediate nodes are placed into a standby mode such that their battery power is conserved.

Conveniently, the EM telemetry transmitters and different ones of the nodes may be configured to transmit on different frequencies such that the signals from different nodes may be readily distinguished from one another. This can facilitate control over the nodes. The frequency used to transmit data rather than an ID number may be used to identify the source of the data.

In some embodiments, the gain of EM telemetry receivers 34 in nodes 30 is variable. Variable gain may be used to increase gain when the receiver finds itself in an environment which is low in electromagnetic interference. Typically, at downhole locations which are significantly removed from the surface, the quantity of electromagnetic interference is significantly decreased. Consequently, at such downhole locations the gain of an EM telemetry receiver can be increased significantly without saturating the receiver with noise signals. Increasing the gain may be used to pick up signals from farther away along the drill string or to pick up signals which are initially transmitted with lower power.

In some embodiments, power is conserved by increasing gain of a receiver 34 in a node 30 while one or both of decreasing the amplitude of a signal being received or transmitting the signal from a farther-away node.

In some embodiments, the gain is increased gradually as the depth increases. This increase can optionally be based on a measure of pressure which, in general, increases with depth in the wellbore. For example, gain of an EM telemetry transceiver amplifier may be made to be directly proportional to the pressure detected by a pressure sensor. In other embodiments, depth is measured indirectly, for example, by the time taken to receive a mud pulse or by way of information regarding the depth of a node received from a separate controller or from surface equipment. In some embodiments, a controller of a node measures a signal-to-noise ratio of received signals and increases the gain if the signal-to-noise ratio is lower than a threshold. The controller may decrease the gain if the signal-to-noise ratio increases above a threshold. In some embodiments, the EM receiver gain may be increased to a value in the range of $10^4$, $10^6$, or even higher.

In some embodiments, EM telemetry transmission power of some nodes and receiver gain of other nodes which receive signals are coordinated. For example, as the depth below the surface increases, a node 30 may both increase the gain of the amplifier on its EM telemetry receiver while it decreases the power of its EM telemetry transmitter. This increase and decrease may be made automatically based on measurements of depth, which may be direct measurements or indirect measurements of depth and/or based on measurements of signal-to-noise ratio in received signals.

EM telemetry signals may be received at the surface using conventional EM telemetry signal receivers or by means of a gap incorporated into the infrastructure of a drilling rig, for example, a gap incorporated into a quill or top drive or the like.

Some nodes 30 may optionally include integrated mud pulsers. In cases where EM telemetry to a next node or to the surface is unreliable or not available because of a poor formation, data may still be transmitted by way of the mud pulser.

A controller in a node 30 may analyze detected signals from other nodes. For example, the analysis may measure signal strength, signal-to-noise ratio, or the like. The signal analysis may also or in the alternative detect harmonics of the signal, for example by performing an FFT transformation to identify such harmonics.

The node may transmit the analysis of the detected signal to the surface and/or to a node from which the signal originated. This analysis information may be used to improve some aspect of data transmission in the wellbore, for example, by setting transmit and/or receive parameters for some or all nodes 30.

Such analysis and transmissions may be used to optimize performance of the network of nodes. For example, suppose that a node 30 notices that a signal from another node known to be located 500 feet (about 160 meters) farther down the drill string is fading. Such fading is likely due to the nature of the formation through which the wellbore passes at the depth of the next node. The node that detects the fading signal may be configured to automatically boost its signal transmission when it gets to the same area at which the signal from the next node down the bore hole started to fade. The node may also transmit to other nodes above it signals indicating the quality of received signals. These informational signals may be processed at the surface or at another location in order to determine areas within the wellbore at which nodes can be controlled to transmit with increased power (as well as or in the alternative other areas where nodes can be controlled to transmit with decreased power).

In some embodiments, node 30 may send a number of parameters to one or more other nodes. These parameters may include, for example, downhole bore pressure (i.e. the hydrostatic pressure measured when no flow is occurring), transmission voltage, transmission current, etc. Upon receiving downhole bore pressure, transmission voltage and/or transmission current, a node 30 may record these values in a table that includes transmission voltage, transmission current and downhole bore pressure values for different depths as well as, at least, the received signal strength at each pressure. This table of values may be continuously added to as drilling is continued. As more nodes 30 pass through a particular depth, the estimate of the transmission power at that depth may become more refined. Using the data in this table of values, a node may adjust its transmission power according to local downhole bore pressure. For example, in some embodiments, when a node 30 approaches a pressure for which it already has data values, it may increase or decrease its transmission power accordingly.

The foregoing discussion explains how a network of nodes 30 may be used to carry data from one or more downhole locations to surface equipment. Such a network may also carry commands and/or other data from surface equipment to nodes 30 and/or to other downhole systems in communication with one or more nodes 30. Thus, such a network may provide two-way data communication between:

- surface equipment and any node 30;
- two nodes 30;
- surface equipment and downhole systems in communication with one or more nodes 30;
- different downhole systems in communication with nodes 30.

Two-way communication to nodes 30 may, for example, be applied to control a specific node 30 or group of nodes 30 to change operating parameters and/or to change the frequency in which certain data is sent and/or to change the selection of data being sent from that node. Such two-way communication may also be applied to diagnose problems with a node and/or to control the node to solve and/or work around such problems.

It is not mandatory that all nodes use the same signal transmission formats. Different nodes may encode data differently depending on local conditions. For example, nodes close to the surface, where there is typically more electrical noise that tends to degrade EM telemetry transmissions, may encode signals using one or more of:

- different error correction codes;
- different encoding schemes;
- different modulation schemes (e.g. FSK, BPSK, QPSK, etc.);
- different frequencies;
- different protocols;
- different numbers of cycles/bit;
- etc.

Figure 5:
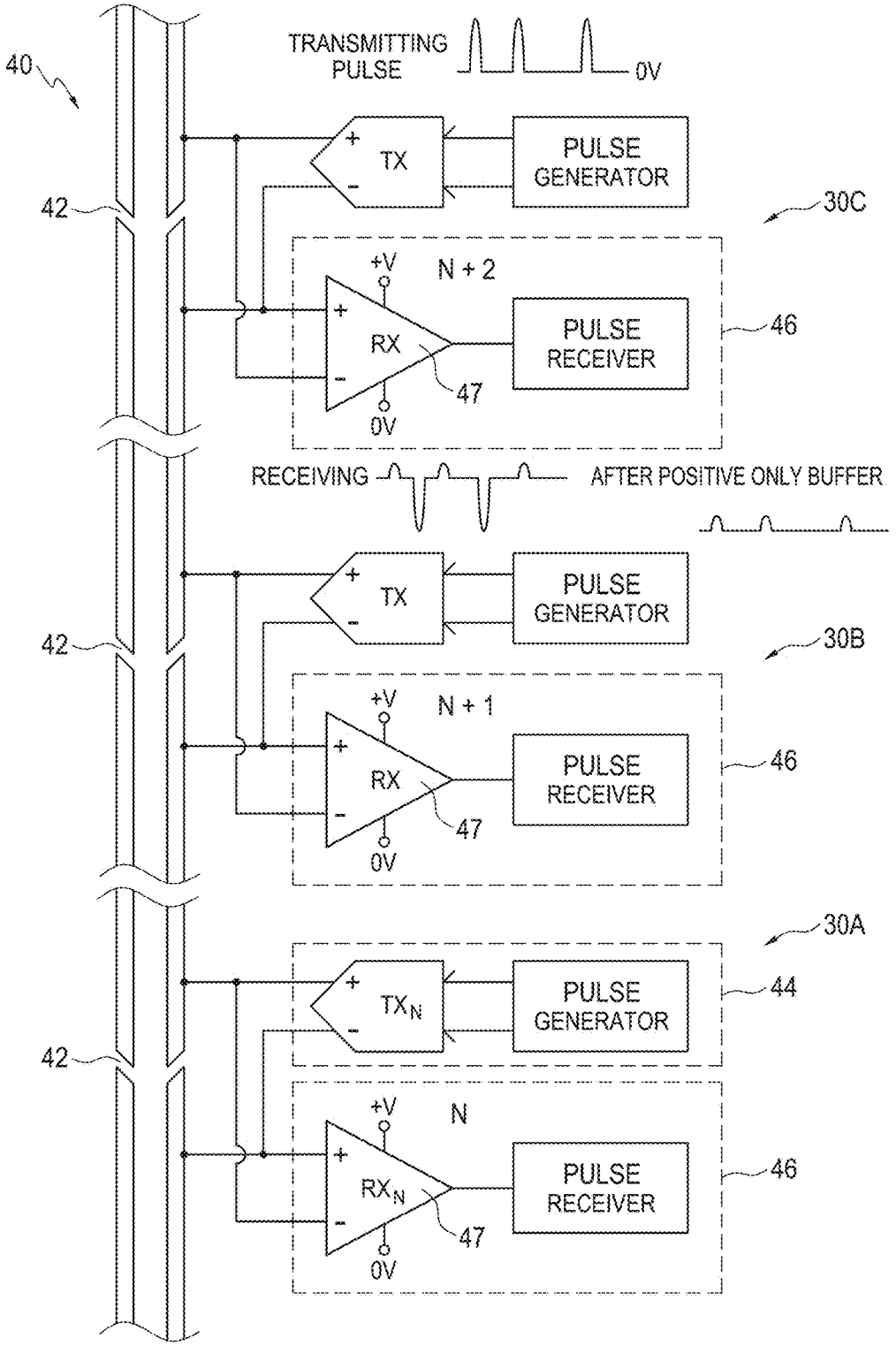
FIG. 5 is a schematic view of a drill string section having several EM telemetry nodes.

In some embodiments, for example, the embodiment illustrated schematically in FIG. 5, each node 30 provides an electrically-insulating gap in the drill string which separates electrically conductive portions of the drill string above and below the gap. Each node comprises an EM telemetry transmitter which can apply potential differences across the corresponding gap. FIG. 5 shows a portion of a drill string 40 having a plurality of nodes 30 spaced apart along it. Each node is associated with an electrically insulating gap 42 and has an EM telemetry transmitter 44 which can apply potential differences across the gap. EM telemetry transmitter 44 may, for example, comprise an H-bridge circuit.

In this example embodiment, each node 30 also includes an EM telemetry receiver 46 connected across the corresponding gap 42. Telemetry receivers 46 are configured to receive signals of different polarities from the EM telemetry signals transmitted by EM telemetry transmitters 44. For example, where an EM telemetry transmitter 44 transmits signals using positive electrical pulses (i.e. signals in which the uphole side of gap 42 is made positive relative to the downhole side of gap 42) this results in a negative pulse being received at the next node 30 uphole (i.e. the transmitted signal results in the uphole side of gap 42 of the next node 30 being negative relative to the downhole side of the gap 42). Consequently, at any particular node 30, signals being received are opposite in polarity from signals being transmitted. By using uni-polar transmit and receive signals, it is possible to separate the transmit and receive signals at any particular node 30.

For example, EM telemetry receivers 46 may be uni-polar receivers (i.e. receivers which block or are not sensitive to signals of one polarity). The illustrated EM telemetry receivers 46 each has a positive input 46+ and a negative input 46−. EM telemetry receiver 46 can detect signals in which the positive input 46+ has a potential that is positive relative to negative input 46−. EM telemetry receiver 46 does not detect signals in which the positive input 46+ has a potential that is negative relative to negative input 46−. EM telemetry receiver 46 may, for example, comprise a diode or other half-wave rectifier connected in series with one or both of inputs 46+ and 46− and/or a difference amplifier which amplifies signals of one polarity and not the other polarity.

FIG. 5 shows nodes 30A, 30B and 30C in communication with one another. In each node 30 a transmitter 44 and receiver 46 are connected across a gap 42. The transmitter 44 and receiver 46 are connected across gap 42 with opposite polarities. In the illustrated embodiment the positive output of uni-polar transmitter 44 is connected to the uphole side of gap 42 while the negative input 46− of uni-polar receiver 46 is connected to the uphole side of gap 42. The negative output of transmitter 44 and the positive input 46+ of receiver 46 are connected to the downhole side of the gap 42.

When transmitter 44 of node 30A applies positive pulses across gap 42 such that the uphole side of gap 42 is positive (here, 'positive pulse' means a pulse in which the uphole side of gap 42 is made positive relative to the downhole side of gap 42) a negative pulse is induced at the gap 42 of an adjacent node 30 (e.g. node 30B in this example). The transmitted pulses are not received by the receiver at node 30A because they are of the wrong polarity to be received by that receiver. However, the receiver at node 30B can detect the negative pulses induced across the gap 42 at node 30B.

In this embodiment the width (duration) of transmitted pulses may be narrow or wide. Narrower pulses may be used to achieve higher data rates and lower power consumption. Wider pulses may be used to transmit over longer distances and/or in formations having higher electrical conductivity. The height of transmitted pulses may be selected to allow the pulses to be received with a desired strength. For example, transmitted pulses may have pulse heights in the range of a few mV to few kV.

In the embodiment of FIG. 5, receivers 46 include uni-polar buffer amplifiers 47 which electively amplify signals of one polarity.

The polarities indicated in FIG. 5 are reversed in some alternative embodiments. In such alternative embodiments a node may transmit signals by applying negative pulses across the associated gap 42 such that positive pulses are induced across the gap at an adjacent node. (here, 'negative pulse' means a pulse in which the uphole side of gap 42 is made negative relative to the downhole side of gap 42). In such an embodiment, uni-polar receivers may be provided which detect positive pulses across the corresponding gaps 42 but are insensitive to negative pulses across the same gaps 42.

In some embodiments, the transmitted signals are relatively high in voltage. For example, the voltage difference across a gap 42 may be at least 50 volts and in some embodiments at least 100 volts or at least 300 volts in some embodiments.

In some embodiments (whether or not signal transmission is done by way of uni-polar signals), EM telemetry signals are transmitted at higher amplitudes to improve the range of the EM telemetry signals (thereby permitting nodes to be farther apart and/or facilitating transmission across structures such as a mud motor which may introduce noise into transmitted signals). For example, EM telemetry signals may be transmitted using higher voltages (e.g. voltages in excess of 50 volts and up to several hundred volts). Electrical power may be conserved while transmitting EM telemetry signals at such high voltages by making the periods of transmitted signals very short. For example, EM telemetry signals may comprise a series of narrow pulses. By using narrow pulses the frequency of transmitted signals may be high (for example, the frequencies may exceed a few hundred Hz). For example, frequencies of 500 Hz to 2 kHz or higher may be used.

High frequencies permit higher data rates. Various protocols may be used to transmit the data. For example, an 8 PSK protocol may be used to transmit data. In some embodiments, this high amplitude high frequency signal transmission scheme is used only by some parts of a system. Other parts of the system may use other transmitting and encoding schemes. For example, a high amplitude, high frequency EM telemetry protocol may be used to transmit data from a downhole system located between a mud motor and a drill bit to a node 30 located above the mud motor.

The resulting signals may have lower data rates than those signals transmitted in deeper parts of the wellbore. To compensate for this, in some embodiments, nodes in uphole parts of the wellbore may break the data to be transmitted into two or more parts and simultaneously transmit the two or more parts of the data in separate telemetry transmissions having an aggregate data rate sufficient to carry the data being transmitted from the downhole sensors. The separate telemetry transmissions may, for example, use different frequencies.

Nodes as described herein may take any of a wide range of form factors. For example, the nodes could each comprise a gap sub. Electronic components of the nodes may be located in compartments in walls of the gap sub, in a housing held in a bore of the gap sub, or in another suitable location.

In some embodiments described herein, EM telemetry data is transmitted by a transmitter that is separated from a receiver in the drill string and/or separated from the drill bit (which typically serves as a ground connection) by one or more electrically-insulating gaps. In such embodiments, transmission of data across such gaps may be facilitated by selectively shorting the gaps and/or providing signal transmitting filters in the gaps as described in PCT Patent Application No. PCT/CA2013/050683 filed on 5 Sep. 2013 which is hereby incorporated herein by reference.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

Interpretation of Terms

Unless the context clearly requires otherwise, throughout the description and the claims:

- "comprise", "comprising", and the like are to be construed in an inclusive sense, as opposed to an exclusive or exhaustive sense; that is to say, in the sense of "including, but not limited to".
- "connected", "coupled", or any variant thereof, means any connection or coupling, either direct or indirect, between two or more elements; the coupling or connection between the elements can be physical, logical, or a combination thereof.
- "herein", "above", "below", and words of similar import, when used to describe this specification shall refer to this specification as a whole and not to any particular portions of this specification.
- "or", in reference to a list of two or more items, covers all of the following interpretations of the word: any of the items in the list, all of the items in the list, and any combination of the items in the list.
- the singular forms "a", "an", and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back"," "top", "bottom", "below", "above", "under", and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a circuit, module, assembly, device, drill string component, drill rig system, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions and sub-combinations as may reasonably be inferred. The scope of the claims should not be limited by the preferred embodiments set forth in the examples, but should be given the broadest interpretation consistent with the description as a whole.

Some embodiments provide an improved downhole electronic system data network in which a plurality of nodes are attached to a drill string to relay information to the surface. The nodes relay information to surface equipment using relatively high frequency EM transmissions, generally greater than 20 Hz, providing faster data rates and lower latency.

The downhole data network node of certain embodiments of the present invention comprises an EM telemetry transmitter, EM telemetry receiver, a controller and an electrically-insulating gap. The EM telemetry receiver is configured to monitor a potential difference across the gap and to communicate changes in the potential difference to the controller. The EM telemetry transmitter is connected to the controller and configured to apply a voltage signal across the gap. In one embodiment, when the EM telemetry receiver detects a potential difference across the gap, signifying a data transmission, the EM telemetry receiver provides the data transmission to the controller which in turn causes the EM telemetry transmitter to transmit the data transmission to an adjacent node or surface equipment.

What is claimed is:

1. A method for data telemetry from a downhole location, the method comprising:

providing a plurality of telemetry relay devices at locations spaced apart along a drill string, each of the telemetry relay devices comprising an electromagnetic telemetry signal receiver and an electromagnetic telemetry signal transmitter;

moving the drill string in a wellbore;

identifying a first region of the wellbore in which electromagnetic telemetry transmissions are attenuated more strongly and a second region of the wellbore in which electromagnetic telemetry transmissions are attenuated less strongly;

passing data up the drill string by sequentially relaying the data by electromagnetic telemetry from one of the relay devices to another; and, boosting the signal transmission of the telemetry relay devices while those telemetry relay devices are in the first region, and based on a signal detected from the telemetry relay devices in the first region, automatically inhibiting operation of some of the telemetry relay devices while those telemetry relay devices are in the second region.

2. A method for data telemetry from a downhole location, the method comprising:

providing a drill string in a wellbore, the wellbore passing through formations such that a range of electromagnetic telemetry transmissions varies as a function of depth in the wellbore;

passing data from a downhole location to the surface using a plurality of telemetry relay devices between the downhole location and the surface;

identifying first and second non-adjacent ones of the telemetry relay devices such that the second one of the telemetry relay devices is within the range for electromagnetic telemetry transmissions corresponding to the location of the first one or the telemetry relay devices; and, inhibiting operation of one or more of the telemetry relay devices between the first and second ones of the telemetry relay devices wherein inhibiting operation of the one or more of the telemetry relay devices comprises placing the node in power-conserving standby mode.

3. A method according to claim 2 comprising advancing the drill string until the range of electromagnetic telemetry transmissions corresponding to the location of the first one of the telemetry relay devices is reduced and then activating one or more of the one or more electromagnetic telemetry relay devices between the first and second ones of the electromagnetic telemetry relay devices.

4. A method according to claim 3 comprising monitoring the range of the electromagnetic telemetry signals by transmitting electromagnetic telemetry signals from a transmitter on the drill string and receiving the electromagnetic telemetry signals transmitted by the transmitter at a plurality of the electromagnetic telemetry relay devices.

5. A method according to claim 4 wherein the transmitter is a transmitter of one of the electromagnetic telemetry relay devices.

* * * * *